US010968600B2

(12) United States Patent
Jelinek et al.

(10) Patent No.: US 10,968,600 B2
(45) Date of Patent: Apr. 6, 2021

(54) DISTRIBUTED HYDRAULIC SYSTEM

(71) Applicant: Clark Equipment Company, West Fargo, ND (US)

(72) Inventors: Vaclav J. Jelinek, River Edge, NJ (US); Michael L. Vought, Moorhead, MN (US); Dobroslav Rak, Kamenice (CZ)

(73) Assignee: CLARK EQUIPMENT COMPANY, West Fargo, ND (US)

( * ) Notice: Subject to any disclaimer, the term of this patent is extended or adjusted under 35 U.S.C. 154(b) by 0 days.

(21) Appl. No.: 16/590,919

(22) Filed: Oct. 2, 2019

(65) Prior Publication Data

US 2020/0102720 A1 Apr. 2, 2020

Related U.S. Application Data

(60) Provisional application No. 62/740,060, filed on Oct. 2, 2018.

(51) Int. Cl.
*E02F 9/08* (2006.01)
*E02F 9/22* (2006.01)

(52) U.S. Cl.
CPC ..... *E02F 9/0875* (2013.01); *E02F 9/2278* (2013.01); *E02F 9/2235* (2013.01)

(58) Field of Classification Search
CPC ..... E02F 9/0875; E02F 9/2235; E02F 9/2267; E02F 9/2275; E02F 9/2278
See application file for complete search history.

(56) References Cited

U.S. PATENT DOCUMENTS

| | | | | |
|---|---|---|---|---|
| 4,621,375 | A | 11/1986 | Simnovec | |
| 4,949,805 | A | 8/1990 | Mather et al. | |
| 5,299,857 | A | 4/1994 | Zanetis | |
| 5,806,313 | A | 9/1998 | Koshi et al. | |
| 6,662,881 | B2 | 12/2003 | Domann | |
| 6,925,807 | B2 | 8/2005 | Jones et al. | |
| 6,947,819 | B2 | 9/2005 | Nelson et al. | |
| 7,021,668 | B2 | 4/2006 | Langenfeld et al. | |
| 7,070,383 | B2 | 7/2006 | Sugimoto | |
| 7,270,046 | B2 * | 9/2007 | Stephenson | B66F 9/0655 137/596.16 |

(Continued)

FOREIGN PATENT DOCUMENTS

JP 2000204583 A 7/2000

OTHER PUBLICATIONS

International Search Report and Written Opinion dated Feb. 27, 2020 for International Application No. PCT/US2019/054253 filed Oct. 2, 2019, 13 pages.

*Primary Examiner* — Michael Leslie
(74) *Attorney, Agent, or Firm* — John Veldhuis-Kroeze; Westman, Champlin & Koehler, P.A.

(57) ABSTRACT

Disclosed embodiments are directed to distributed hydraulic systems, and power machines such as excavators including distributed hydraulic systems. In the distributed hydraulic systems, electronically controlled distributor blocks are located throughout the machine, particularly along the lift arm, to locally distribute hydraulic power to actuators of the various machine and implement functions. Distributing control of hydraulics in multiple locations reduces the number of hoses that must be routed from a main control valve to the various actuators on the machine.

19 Claims, 10 Drawing Sheets

(56) References Cited

U.S. PATENT DOCUMENTS

| | | | | |
|---|---|---|---|---|
| 7,742,861 | B2 | 6/2010 | Lee | |
| 8,047,760 | B2 | 11/2011 | Roan et al. | |
| 8,160,785 | B2 | 4/2012 | Kahle et al. | |
| 8,807,263 | B2 | 8/2014 | Caillieret et al. | |
| 8,909,434 | B2 | 12/2014 | Anders et al. | |
| 9,051,718 | B2 | 6/2015 | Schmidt | |
| 2004/0153230 | A1 | 8/2004 | Villa | |
| 2010/0131157 | A1 | 5/2010 | Kahle et al. | |
| 2016/0010310 | A1 | 1/2016 | Schmidt | |
| 2017/0114594 | A1* | 4/2017 | Anttonen | E21B 19/086 |
| 2017/0274947 | A1 | 9/2017 | Haugen | |
| 2019/0003147 | A1* | 1/2019 | Rosenpek | E02F 3/283 |

* cited by examiner 705
715
212
702
211/212
210/211
710
ELECTRONIC CONTROLLER 740
PUMP(S) 720
PRESSURE 725
RETURN 730
726
731
ELECTRONICALLY CONTROLLED HYDRAULIC FLOW DISTRIBUTOR BLOCK 735
LEFT TRACK 750
RIGHT TRACK 752
BLADE 754
TRACK OFF-SET 756
ANGLE BLADE 758
785
TANK 780

DISTRIBUTED HYDRAULIC SYSTEM

CROSS-REFERENCE TO RELATED APPLICATION

This application claims the benefit of U.S. Provisional Application No. 62/740,060, which was filed on Oct. 2, 2018.

BACKGROUND

This disclosure is directed toward power machines. More particularly, this disclosure is directed to power machines with hydraulic systems, such as excavators.

Power machines, for the purposes of this disclosure, include any type of machine that generates power for the purpose of accomplishing a particular task or a variety of tasks. One type of power machine is a work vehicle. Work vehicles are generally self-propelled vehicles that have a work device, such as a lift arm (although some work vehicles can have other work devices) that can be manipulated to perform a work function. Work vehicles include excavators, loaders, utility vehicles, tractors, and trenchers, to name a few examples.

In work vehicles such as excavators, to power the various movements of the vehicle, or have functionality of powered implements, a hydraulic system must provide pressurized hydraulic fluid to the actuator of each function. Typically, in the construction equipment industry, the hydraulic system of the work vehicle includes a control valve that is centrally located in an upper structure of the vehicle, and the hydraulic power is distributed from the control valve through pairs of hoses each dedicated to a different function and routed to the actuator that provides the function. For power machines having lift arms, this can require multiple pairs of hoses routed along the length of the lift arm to control functions such as lift, tilt and auxiliary functions, including those functions performed by an actuator on an attached implement. For multi-function implements, it is possible to mount a separate control valve on the implement itself to aid in reducing the routing of hoses. However, mounting control valves on multiple implements can significantly increase the overall costs to an owner of the implements. Further, control compatibility between various implement suppliers is not guaranteed as the electric signals and connections can vary between suppliers, which may require that control units and wiring be replaced to achieve compatibility.

In some excavators, the lift arm structure is mounted to the upper structure, sometimes referred to as a "house", using a swing mount to allow the lift arm structure to pivot or swing laterally relative to the upper structure under the control of a swing actuator. In such excavators, the multiple pairs of hydraulic hoses must typically be routed through the limited space available in the swing mount. With growing requirements of today's multifunction implements and accessories that can require up to five hydraulic circuits to power the various functions, combined with the existing hoses required for conventional lift arm and implement movements, existing routings of hoses are getting ever the more crowded and complicated.

The discussion above is merely provided for general background information and is not intended to be used as an aid in determining the scope of the claimed subject matter.

SUMMARY

Disclosed embodiments are directed to distributed hydraulic systems, and power machines such as excavators including distributed hydraulic systems. In the distributed hydraulic systems, electronically controlled distributor blocks are located throughout the machine, particularly along the lift arm, to locally distribute hydraulic power to actuators of the various machine and implement functions. The distributor blocks control the distribution of hydraulic power based on outputs from a controller responsive to operator inputs. Distributing control of hydraulics in multiple locations reduces the number of hoses that must be routed from a main control valve to the various actuators on the machine. Fewer hoses leads to simplified manufacturing and increased durability as there are fewer connections that could potentially leak and hoses to be routed through junctions such as a swing mount on some excavators.

One general aspect includes a power machine (100; 200; 600) including: a frame (110; 210) having a first frame portion (211); a lift arm structure (230) pivotally coupled to the first frame portion such that the lift arm structure can be raised and lowered; first hydraulic system components (410; 710) positioned on the first frame portion, the first hydraulic system components including at least one hydraulic pump (420; 620; 720; 820) configured to selectively provide pressurized hydraulic fluid; a supply hose (426) configured to carry pressurized hydraulic fluid from the at least one hydraulic pump; a return hose (431) configured to carry a return flow of hydraulic fluid; second hydraulic system components (415), the second hydraulic system components including a first electronically controlled hydraulic flow distributor block (435; 835) positioned on the lift arm structure, the first electronically controlled hydraulic flow distributor block configured to receive the pressurized hydraulic fluid from the supply hose and to selectively divert the pressurized hydraulic fluid to different ones of multiple actuators on the lift arm structure; and an electronic controller (440; 740; 840) positioned on the frame (110; 210) and configured to control the first electronically controlled hydraulic flow distributor block (435) to control the different ones of the multiple actuators on the lift arm structure.

Implementations may include one or more of the following features. The power machine where the frame (110; 210) includes an undercarriage (212), and where the first frame portion (211) includes a house pivotally mounted on the undercarriage by a swivel joint (702). The power machine and further including a swing mount (215) pivotally coupling the lift arm structure to the house, the swing mount configured to allow the lift arm structure to pivot laterally relative to the house under the control of a swing actuator (233*a*), and where the supply hose (426) and the return hose (431) are routed through the swing mount. The power machine where the first electronically controlled hydraulic flow distributor block (435; 835) is positioned at least partially within an arm of the lift arm structure (230). The power machine where the first electronically controlled hydraulic flow distributor block (435; 835) is at least partially positioned within a boom (232) of the lift arm structure (230). The power machine where the first electronically controlled hydraulic flow distributor block (435; 835) includes a plurality of valve bodies each configured to control diversion of the pressurized hydraulic fluid to a different one of the multiple actuators on the lift arm structure. The power machine and further including a plurality of quick couplers (445; 450; 455; 460) configured to removably couple the multiple actuators on the lift arm structure to the first electronically controlled hydraulic flow distributor block (435; 835). The power machine where the second hydraulic system components (415) further include a second electronically controlled hydraulic flow distributor block (535) positioned on the lift arm structure and coupled in-line to the first electronically controlled hydraulic flow distributor block (435; 835) by a first hose (536) and a second hose (537), the second electronically controlled hydraulic flow distributor block (535) configured to receive the pressurized hydraulic fluid from the supply hose (426) and to provide the pressurized hydraulic fluid through the first hose (536) to the first electronically controlled hydraulic flow distributor block (435; 835). The power machine where the electronic controller (440; 740; 840) is further configured to control the second electronically controlled hydraulic flow distributor block (535). The power machine where the multiple actuators on the lift arm structure include a lift actuator (233*b*) configured to raise and lower a boom (232) of the lift arm structure, a dipper actuator (233*c*) configured to move a dipper arm (234) relative to the boom, and an implement carrier actuator (233*d*) configured to move an implement carrier (272) relative to the dipper arm (234). The power machine and further including: an engine (850) configured to drive the at least one hydraulic pump (420; 620; 720; 820); at least one engine feedback sensor (852) configure to provide the electronic controller (440; 740; 840) engine operational feedback signals or data; at least one pump feedback sensor (822) configured to provide the electronic controller pump feedback signals or data indicative of pressure or flow of hydraulic fluid in the at least one hydraulic pump (420; 620; 720; 820); at least one distributor block feedback sensor (837) configured to provide the electronic controller distributor block pressure feedback signals or data indicative of pressure or flow of hydraulic fluid in the first electronically controlled hydraulic flow distributor block (435; 835); where the electronic controller is configured to control the engine (850), the at least one hydraulic pump (420; 620; 720; 820) and the first electronically controlled hydraulic flow distributor block (435; 835) responsive to the engine operational feedback signals or data, the pump feedback signals or data and the distributor block pressure feedback signals or data.

One general aspect includes a power machine (100; 200; 600) including: a frame (110; 210) having a house (211) and an undercarriage (212); a swivel joint (702) pivotally coupling the house to the undercarriage; a lift arm structure (230) pivotally coupled to the house such that the lift arm structure can be raised and lowered; first hydraulic system components (410; 710) positioned on the house, the first hydraulic system components including at least one hydraulic pump (420; 620; 720; 820) configured to selectively provide pressurized hydraulic fluid; a supply hose (726) routed through the swivel joint and configured to carry pressurized hydraulic fluid from the at least one hydraulic pump; a return hose (731) routed through the swivel joint and configured to carry a return flow of hydraulic fluid; second hydraulic system components (715), the second hydraulic system components including a first electronically controlled hydraulic flow distributor block (735; 835) positioned on the undercarriage, the first electronically controlled hydraulic flow distributor block configured to receive the pressurized hydraulic fluid from the supply hose and to selectively divert the pressurized hydraulic fluid to different ones of multiple actuators supported by the undercarriage; and an electronic controller (440; 740; 840) positioned on the frame (110; 210) and configured to control the first electronically controlled hydraulic flow distributor block (735; 835) to control the different ones of the multiple actuators supported by the undercarriage.

Implementations may include one or more of the following features. The power machine and further including a swing mount (215) pivotally coupling the lift arm structure to the house, the swing mount configured to allow the lift arm structure to pivot laterally relative to the house under the control of a swing actuator (233*a*). The power machine where the first electronically controlled hydraulic flow distributor block (735; 835) includes a plurality of valve bodies each configured to control diversion of the pressurized hydraulic fluid to a different one of the multiple actuators supported by the undercarriage. The power machine where the multiple actuators supported by the undercarriage include first and second travel motors (750; 752) configured to control travel of the power machine. The power machine and further including first and second track assemblies (240*a*; 240*b*) coupled to and disposed on opposing sides of the undercarriage, the first and second track assemblies each driven by a respective one of the first and second travel motors. The power machine where the multiple actuators supported by the undercarriage include at least one of a track offset actuator (756) and an angle blade actuator (758). The power machine where the multiple actuators supported by the undercarriage include a lower implement actuator (754) configured raise and lower a lower implement mounted on the undercarriage. The power machine and further including: an engine (850) configured to drive the at least one hydraulic pump (420; 620; 720; 820); at least one engine feedback sensor (852) configure to provide the electronic controller (440; 740; 840) engine operational feedback signals or data; at least one pump feedback sensor (822) configured to provide the electronic controller pump feedback signals or data indicative of pressure or flow of hydraulic fluid in the at least one hydraulic pump (420; 620; 720; 820); at least one distributor block feedback sensor (837) configured to provide the electronic controller distributor block pressure feedback signals or data indicative of pressure or flow of hydraulic fluid in the first electronically controlled hydraulic flow distributor block (735; 835); where the electronic controller is configured to control the engine (850), the at least one hydraulic pump (420; 620; 720; 820) and the first electronically controlled hydraulic flow distributor block (735; 835) responsive to the engine operational feedback signals or data, the pump feedback signals or data and the distributor block pressure feedback signals or data.

This Summary and the Abstract are provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DETAILED DESCRIPTION

The concepts disclosed in this discussion are described and illustrated with reference to exemplary embodiments. These concepts, however, are not limited in their application to the details of construction and the arrangement of components in the illustrative embodiments and are capable of being practiced or being carried out in various other ways. The terminology in this document is used for the purpose of description and should not be regarded as limiting. Words such as "including," "comprising," and "having" and variations thereof as used herein are meant to encompass the items listed thereafter, equivalents thereof, as well as additional items.

Disclosed embodiments are directed to power machines, such as excavators, which include a distributed hydraulic system with electronically controlled distributor blocks that are located throughout the machine, particularly along the lift arm, and locally distribute hydraulic power to actuators of the various machine and implement functions based on outputs from a control unit or central processor that gets inputs from the operator and system. Distributing control of hydraulics in multiple locations reduces the number of hoses that must be routed from a main control valve to the various actuators on the machine. Fewer hoses leads to simplified manufacturing and increased durability as there are fewer connections that could potentially leak and hoses to be routed through junctions such as a swing mount on some excavators.

Figure 2:
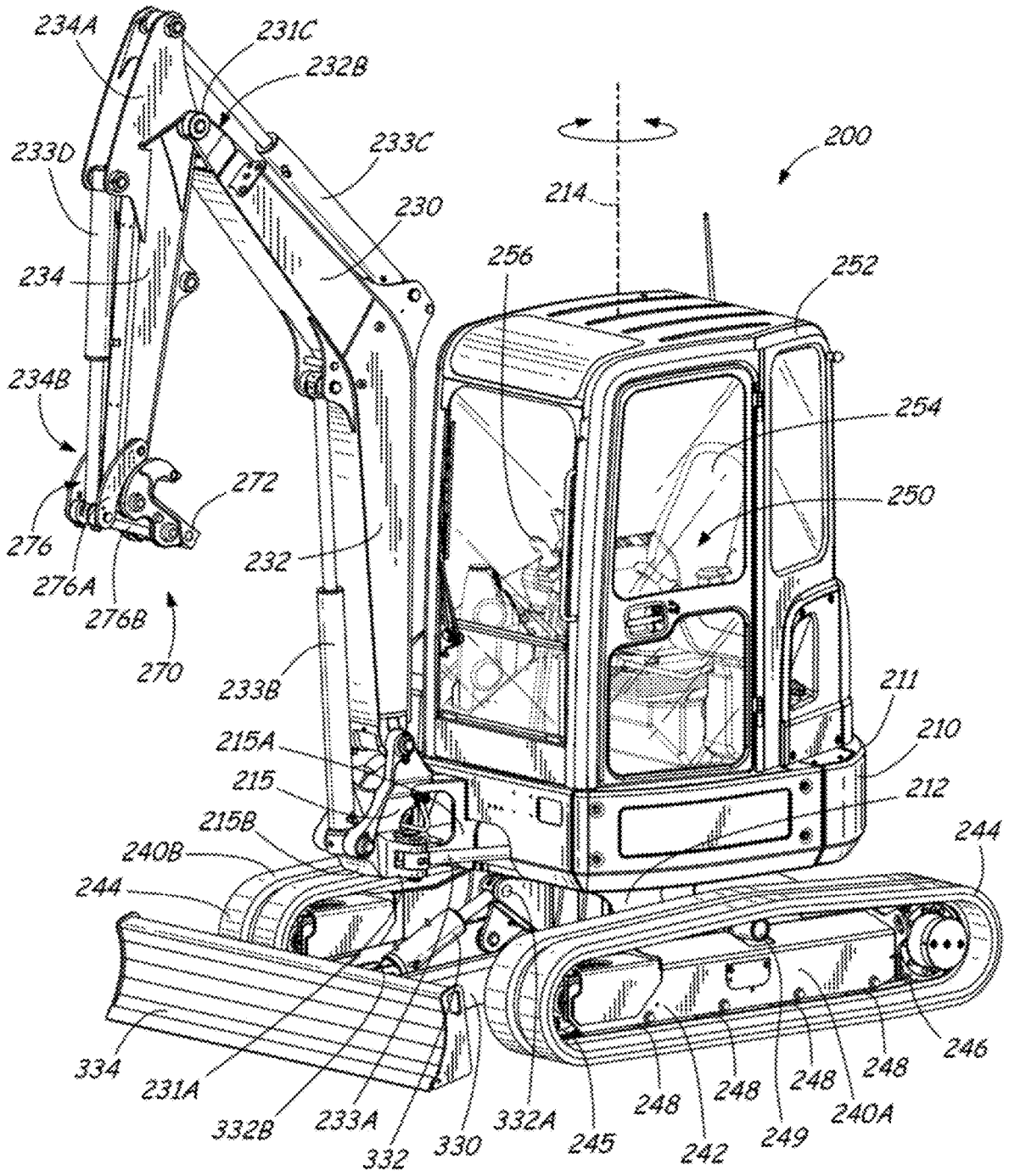
FIG. 2 is a front left perspective view of a representative power machine in the form of an excavator on which the disclosed embodiments can be practiced.
Figure 3:
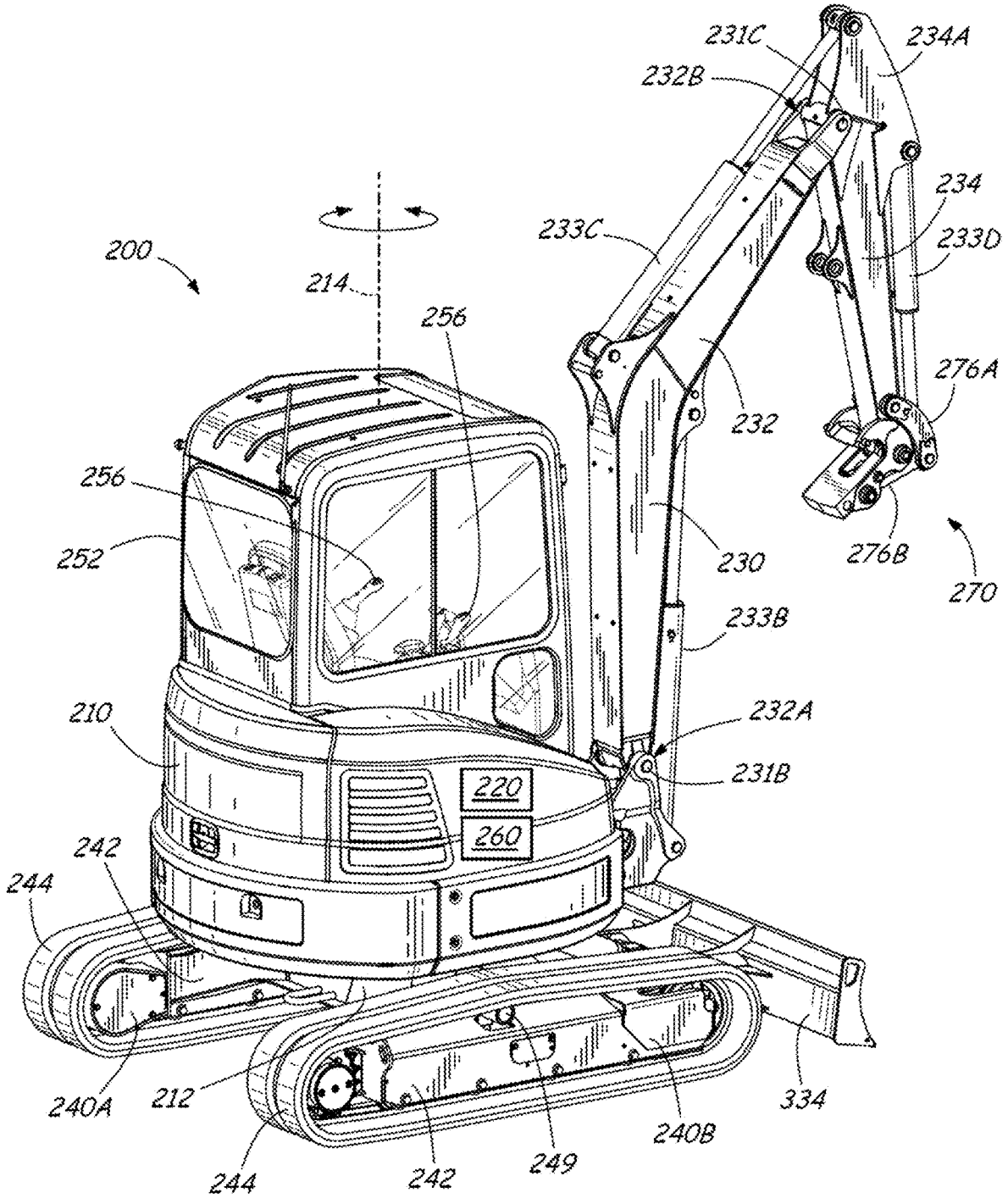
FIG. 3 is a rear right perspective view of the excavator of FIG. 2.

These concepts can be practiced on various power machines, as will be described below. A representative power machine on which the embodiments can be practiced is illustrated in diagram form in FIG. 1 and examples of such a power machine are illustrated in FIGS. 2-4 and described below before any embodiments are disclosed. For the sake of brevity, only a few power machines are discussed. However, as mentioned above, the embodiments below can be practiced on any of a number of power machines, including power machines of different types from the representative power machine shown in FIGS. 2-3. Power machines, for the purposes of this discussion, include a frame, at least one work element, and a power source that is capable of providing power to the work element to accomplish a work task. One type of power machine is a self-propelled work vehicle. Self-propelled work vehicles are a class of power machines that include a frame, work element, and a power source that is capable of providing power to the work element. At least one of the work elements is a motive system for moving the power machine under power.

Figure 1:
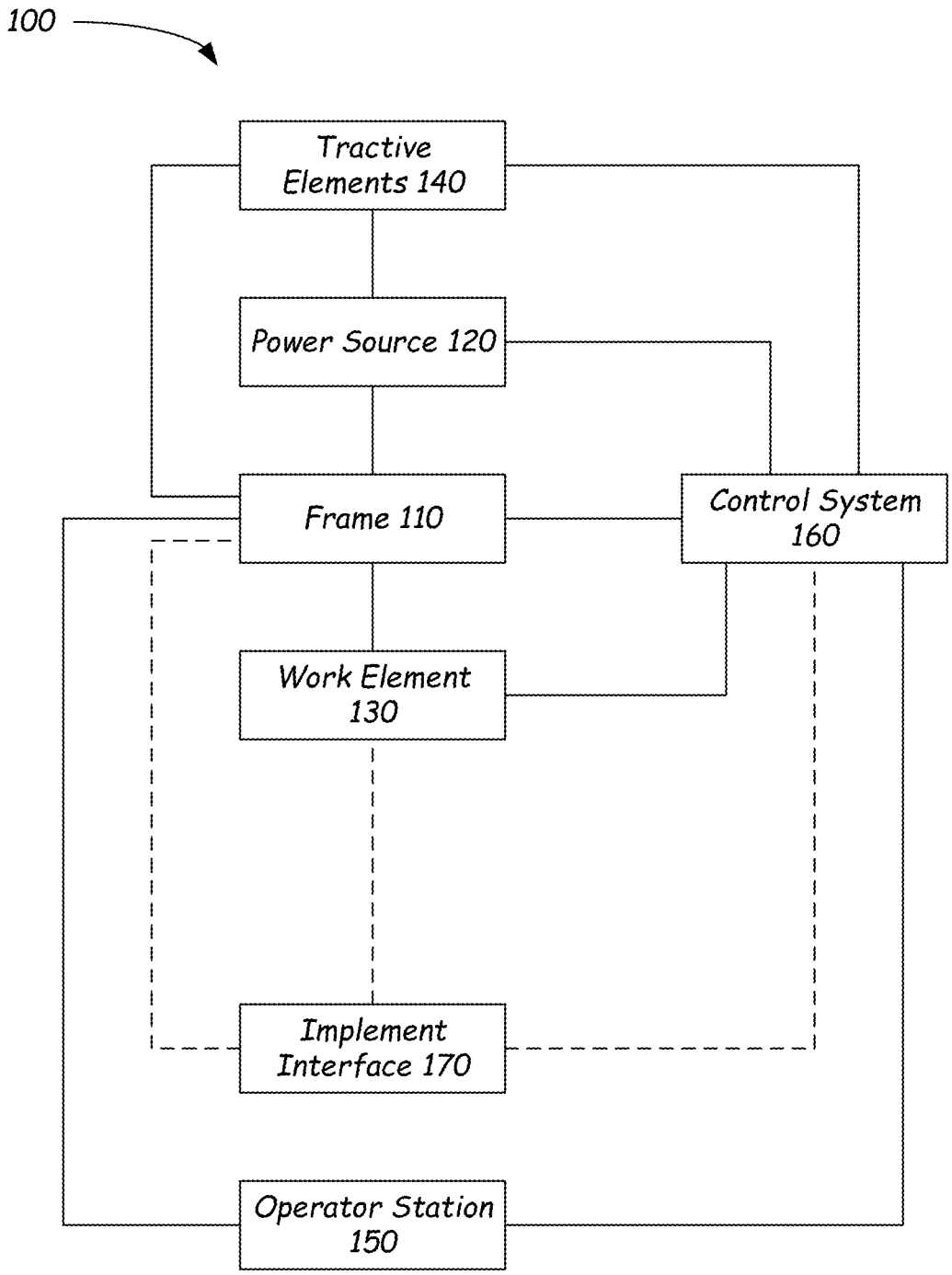
FIG. 1 is a block diagram illustrating functional systems of a representative power machine on which embodiments of the present disclosure can be practiced.

Referring now to FIG. 1, a block diagram illustrates the basic systems of a power machine 100 upon which the embodiments discussed below can be advantageously incorporated and can be any of a number of different types of power machines. The block diagram of FIG. 1 identifies various systems on power machine 100 and the relationship between various components and systems. As mentioned above, at the most basic level, power machines for the purposes of this discussion include a frame, a power source, and a work element. The power machine 100 has a frame 110, a power source 120, and a work element 130. Because power machine 100 shown in FIG. 1 is a self-propelled work vehicle, it also has tractive elements 140, which are themselves work elements provided to move the power machine over a support surface and an operator station 150 that provides an operating position for controlling the work elements of the power machine. A control system 160 is provided to interact with the other systems to perform various work tasks at least in part in response to control signals provided by an operator.

Certain work vehicles have work elements that are capable of performing a dedicated task. For example, some work vehicles have a lift arm to which an implement such as a bucket is attached such as by a pinning arrangement. The work element, i.e., the lift arm can be manipulated to position the implement for performing the task. The implement, in some instances can be positioned relative to the work element, such as by rotating a bucket relative to a lift arm, to further position the implement. Under normal operation of such a work vehicle, the bucket is intended to be attached and under use. Such work vehicles may be able to accept other implements by disassembling the implement/work element combination and reassembling another implement in place of the original bucket. Other work vehicles, however, are intended to be used with a wide variety of implements and have an implement interface such as implement interface 170 shown in FIG. 1. At its most basic, implement interface 170 is a connection mechanism between the frame 110 or a work element 130 and an implement, which can be as simple as a connection point for attaching an implement directly to the frame 110 or a work element 130 or more complex, as discussed below.

On some power machines, implement interface 170 can include an implement carrier, which is a physical structure movably attached to a work element. The implement carrier has engagement features and locking features to accept and secure any of a number of implements to the work element. One characteristic of such an implement carrier is that once an implement is attached to it, it is fixed to the implement (i.e. not movable with respect to the implement) and when the implement carrier is moved with respect to the work element, the implement moves with the implement carrier. The term implement carrier is not merely a pivotal connection point, but rather a dedicated device specifically intended to accept and be secured to various different implements. The implement carrier itself is mountable to a work element 130 such as a lift arm or the frame 110. Implement interface 170 can also include one or more power sources for providing power to one or more work elements on an implement. Some power machines can have a plurality of work element with implement interfaces, each of which may, but need not, have an implement carrier for receiving implements. Some other power machines can have a work element with a plurality of implement interfaces so that a single work element can accept a plurality of implements simultaneously. Each of these implement interfaces can, but need not, have an implement carrier.

Frame 110 includes a physical structure that can support various other components that are attached thereto or positioned thereon. The frame 110 can include any number of individual components. Some power machines have frames that are rigid. That is, no part of the frame is movable with respect to another part of the frame. Other power machines have at least one portion that is capable of moving with respect to another portion of the frame. For example, excavators can have an upper frame portion that rotates with respect to a lower frame portion. Other work vehicles have articulated frames such that one portion of the frame pivots with respect to another portion for accomplishing steering functions.

Frame 110 supports the power source 120, which is capable of providing power to one or more work elements 130 including the one or more tractive elements 140, as well as, in some instances, providing power for use by an attached implement via implement interface 170. Power from the power source 120 can be provided directly to any of the work elements 130, tractive elements 140, and implement interfaces 170. Alternatively, power from the power source 120 can be provided to a control system 160, which in turn selectively provides power to the elements that capable of using it to perform a work function. Power sources for power machines typically include an engine such as an internal combustion engine and a power conversion system such as a mechanical transmission or a hydraulic system that is capable of converting the output from an engine into a form of power that is usable by a work element. Other types of power sources can be incorporated into power machines, including electrical sources or a combination of power sources, known generally as hybrid power sources. In exemplary embodiments, the hydraulic system can be a distributed hydraulic system that reduces the number of hydraulic hoses that must be routed through structures of the power machine.

FIG. 1 shows a single work element designated as work element 130, but various power machines can have any number of work elements. Work elements are typically attached to the frame of the power machine and movable with respect to the frame when performing a work task. In addition, tractive elements 140 are a special case of work element in that their work function is generally to move the power machine 100 over a support surface. Tractive elements 140 are shown separate from the work element 130 because many power machines have additional work elements besides tractive elements, although that is not always the case. Power machines can have any number of tractive elements, some or all of which can receive power from the power source 120 to propel the power machine 100. Tractive elements can be, for example, wheels attached to an axle, track assemblies, and the like. Tractive elements can be rigidly mounted to the frame such that movement of the tractive element is limited to rotation about an axle or steerably mounted to the frame to accomplish steering by pivoting the tractive element with respect to the frame.

Power machine 100 includes an operator station 150, which provides a position from which an operator can control operation of the power machine. In some power machines, the operator station 150 is defined by an enclosed or partially enclosed cab. Some power machines on which the disclosed embodiments may be practiced may not have a cab or an operator compartment of the type described above. For example, a walk behind loader may not have a cab or an operator compartment, but rather an operating position that serves as an operator station from which the power machine is properly operated. More broadly, power machines other than work vehicles may have operator stations that are not necessarily similar to the operating positions and operator compartments referenced above. Further, some power machines such as power machine 100 and others, whether or not they have operator compartments or operator positions, may be capable of being operated remotely (i.e. from a remotely located operator station) instead of or in addition to an operator station adjacent or on the power machine. This can include applications where at least some of the operator controlled functions of the power machine can be operated from an operating position associated with an implement that is coupled to the power machine. Alternatively, with some power machines, a remote control device can be provided (i.e. remote from both of the power machine and any implement to which is it coupled) that is capable of controlling at least some of the operator controlled functions on the power machine.

FIGS. 2-3 illustrate an excavator 200, which is one particular example of a power machine of the type illustrated in FIG. 1, on which the disclosed embodiments can be employed. Unless specifically noted otherwise, embodiments disclosed below can be practiced on a variety of power machines, with the excavator 200 being only one of those power machines. Excavator 200 is described below for illustrative purposes. Not every excavator or power machine on which the illustrative embodiments can be practiced need have all of the features or be limited to the features that excavator 200 has. Excavator 200 has a frame 210 that supports and encloses a power system 220 (represented in FIGS. 2-3 as a block, as the actual power system is enclosed within the frame 210). The power system 220 includes an engine that provides a power output to a hydraulic system. The hydraulic system acts as a power conversion system that includes one or more hydraulic pumps for selectively providing pressurized hydraulic fluid to actuators that are operably coupled to work elements in response to signals provided by operator input devices. The hydraulic system also includes a control valve system that selectively provides pressurized hydraulic fluid to actuators in response to signals provided by operator input devices. In exemplary embodiments, the hydraulic system can be a distributed hydraulic system having electronically controlled distributor blocks that are located at one or more positions on the power machine to reduce the number of hydraulic hoses and connections that are typically required to be routed throughout the machine. The excavator 200 includes a plurality of work elements in the form of a first lift arm structure 230 and a second lift arm structure 330 (not all excavators have a second lift arm structure). In addition, excavator 200, being a work vehicle, includes a pair of tractive elements in the form of left and right track assemblies 240A and 240B, which are disposed on opposing sides of the frame 210.

An operator compartment 250 is defined in part by a cab 252, which is mounted on the frame 210. The cab 252 shown on excavator 200 is an enclosed structure, but other operator compartments need not be enclosed. For example, some excavators have a canopy that provides a roof but is not enclosed A control system, shown as block 260 is provided for controlling the various work elements. Control system 260 includes operator input devices, which interact with the power system 220 to selectively provide power signals to actuators to control work functions on the excavator 200.

Frame 210 includes an upper frame portion or house 211 that is pivotally mounted on a lower frame portion or undercarriage 212 via a swivel joint. The swivel joint includes a bearing, a ring gear, and a slew motor with a pinion gear (not pictured) that engages the ring gear to swivel the machine. The slew motor receives a power signal from the control system 260 to rotate the house 211 with respect to the undercarriage 212. House 211 is capable of unlimited rotation about a swivel axis 214 under power with respect to the undercarriage 212 in response to manipulation of an input device by an operator. Hydraulic conduits are fed through the swivel joint via a hydraulic swivel to provide pressurized hydraulic fluid to the tractive elements and one or more work elements such as lift arm 330 that are operably coupled to the undercarriage 212.

The first lift arm structure 230 is mounted to the house 211 via a swing mount 215. (Some excavators do not have a swing mount of the type described here.) The first lift arm structure 230 is a boom-arm lift arm of the type that is generally employed on excavators although certain features of this lift arm structure may be unique to the lift arm illustrated in FIGS. 2-3. The swing mount 215 includes a frame portion 215A and a lift arm portion 215B that is rotationally mounted to the frame portion 215A at a mounting frame pivot 231A. A swing actuator 233A is coupled to the house 211 and the lift arm portion 215B of the mount. Actuation of the swing actuator 233A causes the lift arm structure 230 to pivot or swing about an axis that extends longitudinally through the mounting frame pivot 231A.

The first lift arm structure 230 includes a first portion, known generally as a boom 232 and a second portion known as an arm or a dipper 234. The boom 232 is pivotally attached on a first end 232A to mount 215 at boom pivot mount 231B. A boom actuator 233B is attached to the mount 215 and the boom 232. Actuation of the boom actuator 233B causes the boom 232 to pivot about the boom pivot mount 231B, which effectively causes a second end 232B of the boom to be raised and lowered with respect to the house 211. A first end 234A of the arm 234 is pivotally attached to the second end 232B of the boom 232 at an arm mount pivot 231C. An arm actuator 233C is attached to the boom 232 and the arm 234. Actuation of the arm actuator 233C causes the arm to pivot about the arm mount pivot 231C. Each of the swing actuator 233A, the boom actuator 233B, and the arm actuator 233C can be independently controlled in response to control signals from operator input devices.

An exemplary implement interface 270 is provided at a second end 234B of the arm 234. The implement interface 270 includes an implement carrier 272 that is capable of accepting and securing a variety of different implements to the lift arm 230. Such implements have a machine interface that is configured to be engaged with the implement carrier 272. The implement carrier 272 is pivotally mounted to the second end 234B of the arm 234. An implement carrier actuator 233D is operably coupled to the arm 234 and a linkage assembly 276. The linkage assembly includes a first link 276A and a second link 276B. The first link 276A is pivotally mounted to the arm 234 and the implement carrier actuator 233D. The second link 276B is pivotally mounted to the implement carrier 272 and the first link 276A. The linkage assembly 276 is provided to allow the implement carrier 272 to pivot about the arm 234 when the implement carrier actuator 233D is actuated.

The implement interface 270 also includes an implement power source (not shown in FIGS. 2-3) available for connection to an implement on the lift arm structure 230 or 234. The implement power source includes pressurized hydraulic fluid port to which an implement can be coupled. The pressurized hydraulic fluid port selectively provides pressurized hydraulic fluid for powering one or more functions or actuators on an implement. The implement power source can also include an electrical power source for powering electrical actuators and/or an electronic controller on an implement. The electrical power source can also include electrical conduits that are in communication with a data bus on the excavator 200 to allow communication between a controller on an implement and electronic devices on the excavator 200. It should be noted that the specific implement power source on excavator 200 does not include an electrical power source.

The lower frame 212 supports and has attached to it a pair of tractive elements 240, identified in FIGS. 2-3 as left track drive assembly 240A and right track drive assembly 240B. Each of the tractive elements 240 has a track frame 242 that is coupled to the lower frame 212. The track frame 242 supports and is surrounded by an endless track 244, which rotates under power to propel the excavator 200 over a support surface. Various elements are coupled to or otherwise supported by the track 242 for engaging and supporting the track 244 and cause it to rotate about the track frame. For example, a sprocket 246 is supported by the track frame 242 and engages the endless track 244 to cause the endless track to rotate about the track frame. An idler 245 is held against the track 244 by a tensioner (not shown) to maintain proper tension on the track. The track frame 242 also supports a plurality of rollers 248, which engage the track and, through the track, the support surface to support and distribute the weight of the excavator 200. An upper track guide 249 is provided for providing tension on track 244 and prevent the track from rubbing on track frame 242.

A second or lower lift arm 330 is pivotally attached to the lower frame 212. A lower lift arm actuator 332 is pivotally coupled to the lower frame 212 at a first end 332A and to the lower lift arm 330 at a second end 332B. The lower lift arm 330 is configured to carry a lower implement 334. The lower implement 334 can be rigidly fixed to the lower lift arm 330 such that it is integral to the lift arm. Alternatively, the lower implement can be pivotally attached to the lower lift arm via an implement interface, which in some embodiments can include an implement carrier of the type described above. Lower lift arms with implement interfaces can accept and secure various different types of implements thereto. Actuation of the lower lift arm actuator 332, in response to operator input, causes the lower lift arm 330 to pivot with respect to the lower frame 212, thereby raising and lowering the lower implement 334.

Upper frame portion 211 supports cab 252, which defines, at least in part, operator compartment or station 250. A seat 254 is provided within cab 252 in which an operator can be seated while operating the excavator. While sitting in the seat 254, an operator will have access to a plurality of operator input devices 256 that the operator can manipulate to control various work functions, such as manipulating the lift arm 230, the lower lift arm 330, the traction system 240, pivoting the house 211, the tractive elements 240, and so forth.

Excavator 200 provides a variety of different operator input devices 256 to control various functions. For example, hydraulic joysticks are provided to control the lift arm 230, and swiveling of the house 211 of the excavator. Foot pedals with attached levers are provided for controlling travel and lift arm swing. Electrical switches are located on the joysticks for controlling the providing of power to an implement attached to the implement carrier 272. Other types of operator inputs that can be used in excavator 200 and other excavators and power machines include, but are not limited to, switches, buttons, knobs, levers, variable sliders and the like. The specific control examples provided above are exemplary in nature and not intended to describe the input devices for all excavators and what they control.

Display devices are provided in the cab to give indications of information relatable to the operation of the power machines in a form that can be sensed by an operator, such as, for example audible and/or visual indications. Audible indications can be made in the form of buzzers, bells, and the like or via verbal communication. Visual indications can be made in the form of graphs, lights, icons, gauges, alphanumeric characters, and the like. Displays can be dedicated to provide dedicated indications, such as warning lights or gauges, or dynamic to provide programmable information, including programmable display devices such as monitors of various sizes and capabilities. Display devices can provide diagnostic information, troubleshooting information, instructional information, and various other types of information that assists an operator with operation of the power machine or an implement coupled to the power machine. Other information that may be useful for an operator can also be provided.

The description of power machine 100 and excavator 200 above is provided for illustrative purposes, to provide illustrative environments on which the embodiments discussed below can be practiced. While the embodiments discussed can be practiced on a power machine such as is generally described by the power machine 100 shown in the block diagram of FIG. 1 and more particularly on an excavator such as excavator 200, unless otherwise noted, the concepts discussed below are not intended to be limited in their application to the environments specifically described above.

Figure 4A:
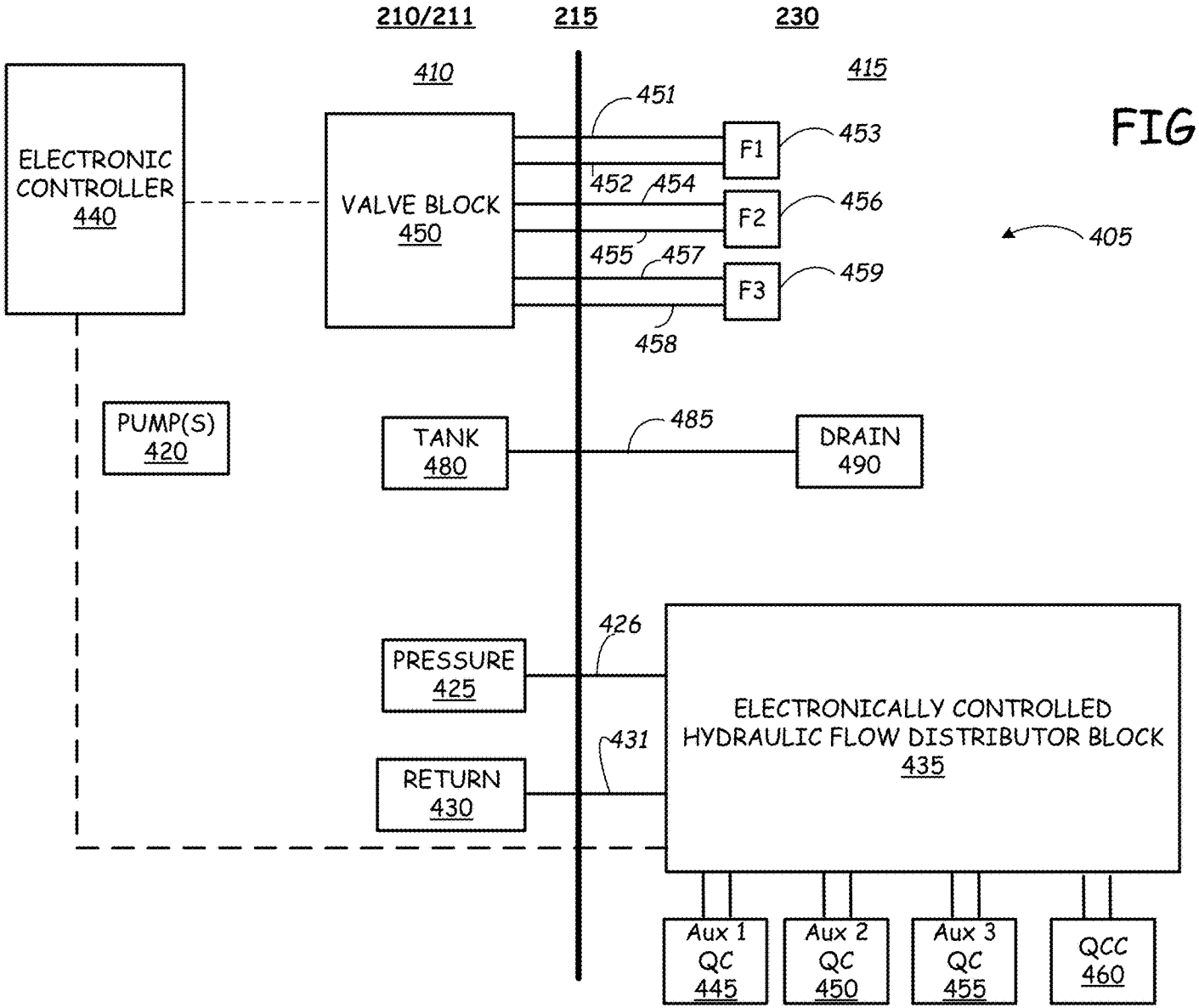
FIG. 4A is a block diagram illustrating a distributed hydraulic system in accordance with one exemplary embodiment which reduces a number of hydraulic lines routed through a swing mount.

Referring now to FIG. 4A, shown is a block diagram illustrating a distributed hydraulic system 405 that can be used on power machines such as those discussed above with reference to FIGS. 1-3. An exemplary embodiment of the distributed hydraulic system 405 is discussed with reference to excavator 200 as shown in FIGS. 2-3. Distributed hydraulic system 405 includes hydraulic system components 410 which are positioned on frame 210 or upper frame portion or housing 211, and hydraulic system components 415 which are positioned on the lift arm structure 230. Using the distributed hydraulic system 405, a reduced number of hydraulic lines must be routed through swing mount 215, which provides potential benefits such as simplified manufacturing, reduced cost, and improved durability. In the illustrated example, nine hydraulic lines are routed through swing mount 215 to provide power to functions that conventionally would have taken fifteen hydraulic lines.

Hydraulic system components 410 which are positioned on house 211 include components such as one or more hydraulic pumps 420, a hydraulic fluid reservoir or tank 480, and other components which control the flow of pressurized hydraulic fluid on lines through swing mount 215. For example, a control valve block 450 can be included in hydraulic system components 410 and configured to control the flow of pressurized hydraulic fluid provided by pump(s) 420 for controlling a boom arm actuator or cylinder (function F1 shown at 453), a dipper arm actuator or cylinder (function F2 shown at 456), and a tilt or bucket actuator or cylinder (function F3 shown at 459). In this embodiment, two hydraulic lines from valve block 450 are routed through swing mount 215 for each of the three functions, with hydraulic lines 451 and 452 provided for the boom arm actuator, hydraulic lines 454 and 455 provided for the dipper arm actuator, and hydraulic lines 457 and 458 provided for the tilt or bucket actuator.

In the exemplary embodiment of FIG. 4A, hydraulic system components 410 also include a control valve or other devices for providing pressurized hydraulic fluid at pressure connection 425 coupled to hydraulic hose 426 that extends through swing mount 215. Similarly, hydraulic system components 410 also include a return hydraulic connection 430 coupled to a return hydraulic hose 431 also extending through swing mount 215. Finally, a hydraulic hose 485 connected to tank 480 is a ninth hydraulic hose extending through the swing mount 215. As will be discussed further below, this represents a significant reduction in the number of hydraulic hoses extending through swing mount 215.

Figure 5:
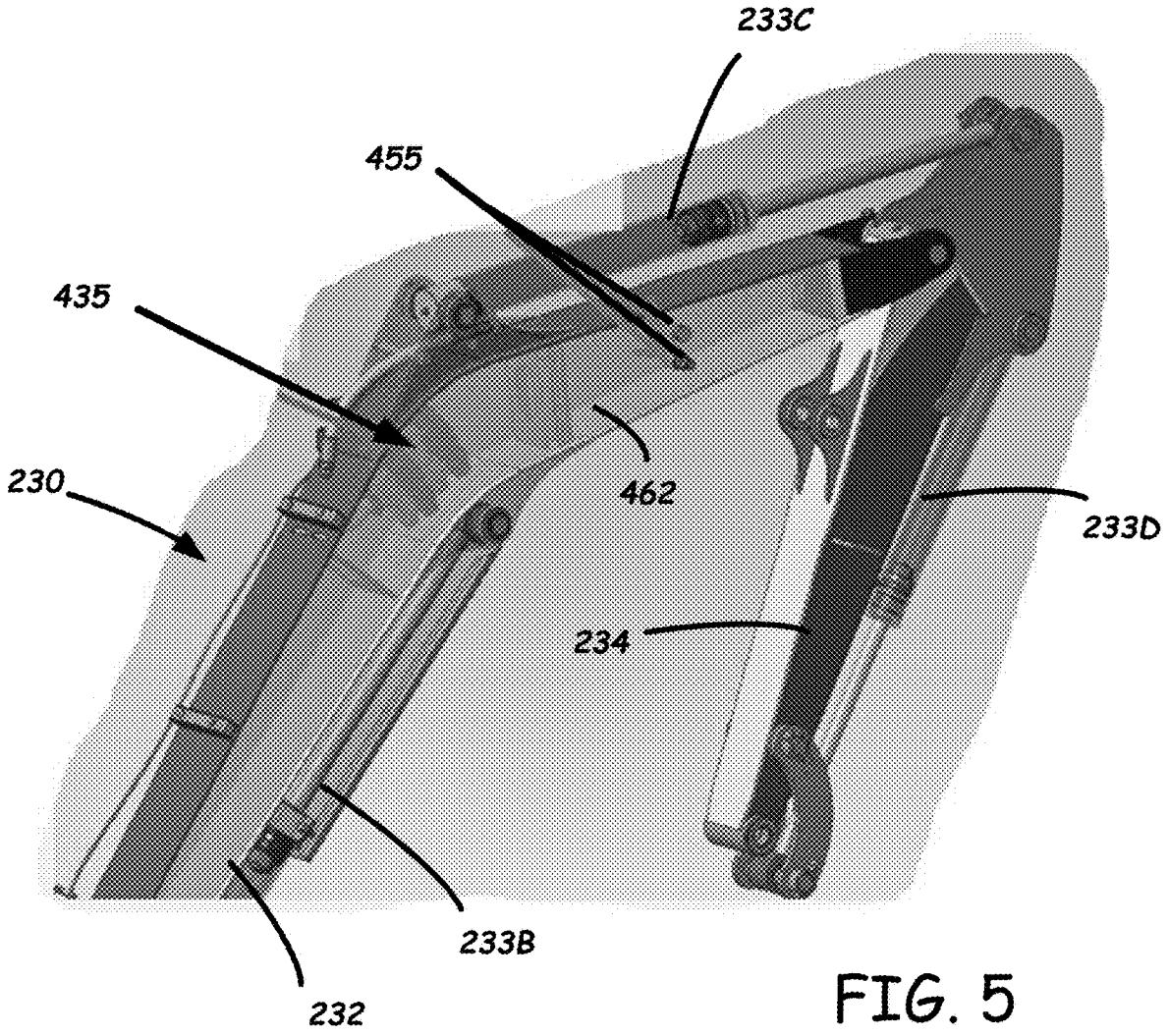
FIGS. 5 and 6 are diagrammatic perspective views of portions of a lift arm structure illustrating features of some distributed hydraulic system embodiments.
Figure 6:
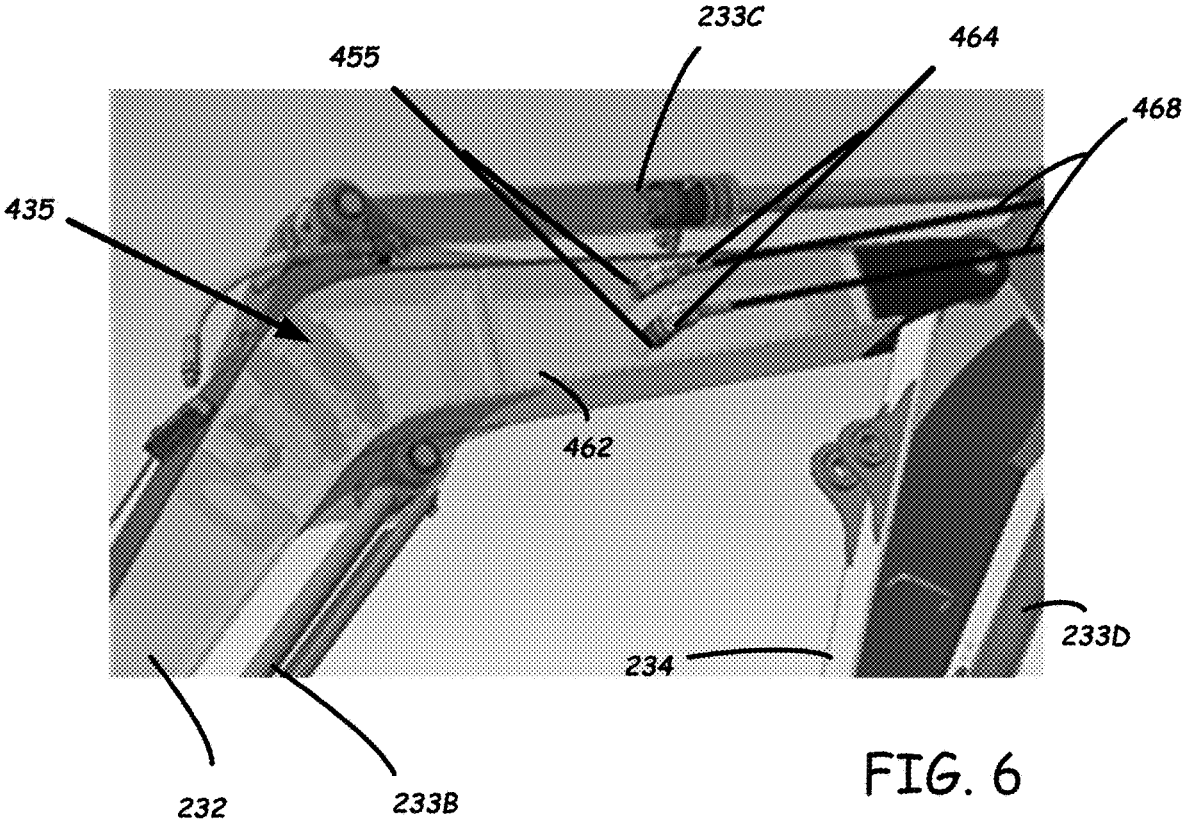

As shown in FIG. 4A, hydraulic system components 415 which are located on lift arm structure 230 in distributed hydraulic system 405 include an electronically controlled hydraulic flow distributor block 435 which is coupled to pressure and return hydraulic hoses 426 and 431. Electronically controlled hydraulic flow distributor block 435 can be positioned inside of an arm of lift arm structure 230, for example inside of boom 232. This is shown, for example, in the diagrammatic perspective views of lift arm structure 230 shown in FIGS. 5 and 6. In an exemplary embodiment, distributor block 435 contains multiple valve bodies that are configured to control multiple auxiliary functions or actuators on the lift arm structure or on any attached implements that might be connected to the lift arm structure. Connections to such actuators is achieved using hydraulic flow quick couplers 445, 450 and 455, each of which is positioned on the lift arm structure or on an implement interface attached to the lift arm structure. Hydraulic coupler 460 can be a dedicated line for the operation of implement interface 270 in the case that it is a hydraulically powered interface. In such an embodiment, the line of hydraulic coupler 460 typically requires specific command and control functions that meet any applicable specific standards. Hydraulic lines connect each quick coupler to distribution block 435. As shown in FIGS. 5 and 6, quick couplers such as couplers 455 can be positioned on a surface 462 of boom 232, and extend perpendicularly from this side surface 462 to provide a more ergonomic coupling position for the operator to connect connectors 464 of auxiliary function hydraulic hoses 468 to distributor block 435. Other quick couplers (e.g., couplers 445 and 450) can be positioned on surfaces of the lift arm structure, or interior to the lift arm structure. Still other couplers, such as hydraulically operated coupler 460, can are used to operate hydraulically powered interfaces such as interface 270.

As discussed, distributor block 435 includes multiple valve bodies that are configured to divert flow of pressurized hydraulic fluid to actuators associated with auxiliary hydraulic functions coupled to quick couplers 445, 450, 455, and/or 460. Distributor block 435 is electronically controlled under the control of an electronic controller 440. As such, distributor block 435 can include solenoid controlled spool valves or other types of electrically controlled valve bodies. In addition to reducing the number of hydraulic hoses which are routed through swing mount 215 for purposes of controlling auxiliary functions such as those performed by an attached implement, positioning distributor block 435 interior to boom 232 allows hydraulic couplers which connect the distributor block valve bodies to the various actuators can be recessed at least partially within the boom to provide added protection. This also allows a change of positioning of the couplers to make it easier for an operator to make the hydraulic connections with push type removable couplers.

With only two hydraulic lines 426 and 431 required for distributor block 435, six hydraulic lines 451, 452, 454, 455, 457 and 458 required for arm actuators, and one hydraulic line 485 required to connect a drain 490 to tank 480, a total of only nine hydraulic hoses need to be routed through swing mount 215, which is significantly less than the number which has been conventionally typical (fifteen to provide the functions of this example embodiment).

Figure 4B:
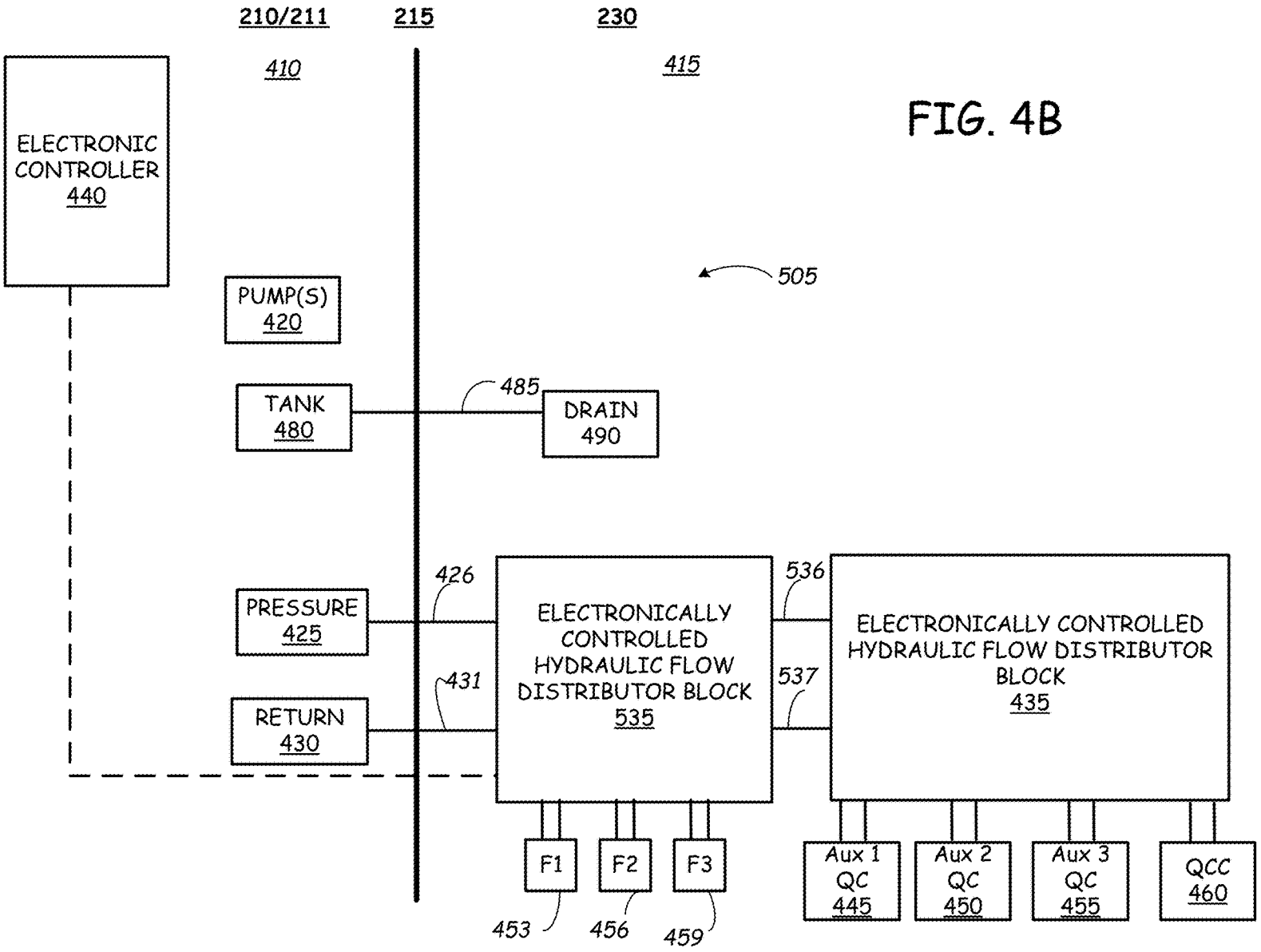
FIG. 4B is a block diagram illustrating a distributed hydraulic system in accordance with another exemplary embodiment which reduces a number of hydraulic lines routed through a swing mount.

Referring next to FIG. 4B, shown is another example embodiment of a distributed hydraulic system 505 demonstrating that the use of electronically controlled distributor blocks to reduce the number of hydraulic hoses passing through swing mount 215 can be extended to the use of additional distributor blocks as well. For example, in system 505, distributor block 535 is added to control the boom arm actuator or cylinder (function F1 shown at 453), the dipper arm actuator or cylinder (function F2 shown at 456), and the tilt or bucket actuator or cylinder (function F3 shown at 459). In this embodiment, the two hydraulic lines 426 and 431 routed through the swing mount 215 for distributor block 435 are provided first to distributor block 535, eliminating the six hydraulic lines shown in FIG. 4A between valve block 450 and these functions. Electronically controlled distributor block 435 is then connected to distributor block 535 through a pair of hydraulic hoses 536 and 537. As was discussed above with reference to FIG. 4A, distributor block 435 is configured to control auxiliary functions or actuators on the lift arm structure or on any attached implements that might be connected to the lift arm structure through hydraulic flow quick couplers 445, 450 and 455, or hydraulically operated coupler 460, each of which is positioned on the lift arm structure or on an implement carrier or interface attached to the lift arm structure. Using multiple in-line distributor blocks on the lift arm structure side of the swing mount 215 greatly reduces the number of hydraulic lines which must be routed through the swing mount 215. For instance, in hydraulic system 505, only three hydraulic lines are routed through swing mount 215, instead of the nine hydraulic lines in system 405 or fifteen in the current embodiment.

Figure 7:
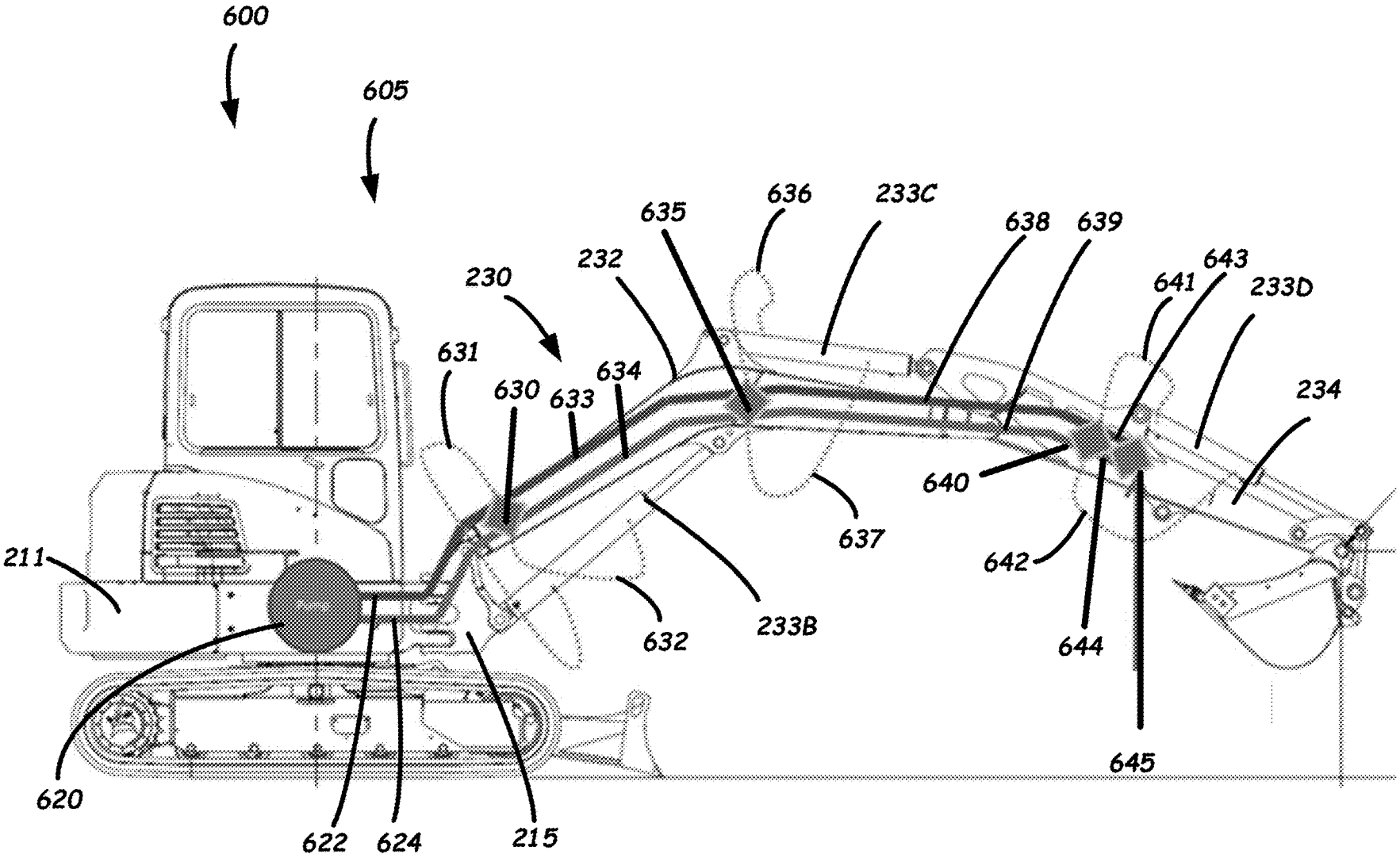
FIG. 7 is a diagrammatic side view illustrating an excavator having a distributed hydraulic system in accordance with yet another exemplary embodiment.

In still other embodiments, additional electronically controlled hydraulic flow distributor blocks can be positioned in a serial configuration along a length of the lift arm structure. For example, FIG. 7 illustrates a power machine 600 with a distributed hydraulic system 605 in which only two hydraulic hoses pass through swing mount 215, though in other embodiments a drain line may still be required as a third hydraulic hose passing through swing mount 215. One of the benefits of configurations such as shown in FIG. 7 is that a larger distributer block (e.g., block 535 discussed above) is broken up into smaller, dedicated control actuators. Whether or not a separate drain line is required in such a configuration depends on how high the back pressure is. In general, back pressure should be lower in such a configuration due to the fact there are fewer obstructions in the return line back to the tank.

As shown in FIG. 7, a pump 620 is positioned on house 211, and a pressure line 622 and a return line 624 routed through swing mount 215 connect pump 620 to a first electronically controlled distributor block 630. The first electronically controlled distributor block 630 is coupled by hydraulic hoses 631 and 632 to lift actuator 233B. A pair of pressure and return hydraulic hoses 633 and 634 then connect first distributor block 630 to a second distributor block 635 positioned at a more distal location along the length of boom 232. Second distributor block 635 is coupled by a pair of hydraulic hoses 636 and 637 to lift arm actuator 233C, and is further coupled by pressure and return hydraulic hoses 638 and 639 to a third electronically controlled hydraulic flow distributor block 640. Distributor block 640 is hydraulically coupled by hoses 641 and 642 to tilt actuator 233D to control tilt functions. Pressure and return hydraulic hoses 643 and 644 then connect distributor block 635 to another electrically controlled hydraulic flow distributor block 645. Distributor block 645 can provide controlled distribution of hydraulic fluid to perform auxiliary functions, for example such as those performed by an actuator on an attached implement.

While four separate electronically controlled distributor blocks are illustrated in FIG. 7, it must be understood that, in some embodiments, distributor blocks can be combined such that the total number is less than four. Further, in other embodiments, additional distributor blocks can be included in the series configuration to control other functions, such as the perpendicularly mounted quick couplers 455 shown in FIGS. 5 and 6. In this embodiment, with all distributor blocks connected in a series configuration, the number of hydraulic hoses that must be routed through swing mount 215 is reduced to only two. Each of the distributor blocks shown in FIG. 7 are electronically controlled by a controller responsive to operator inputs.

Figure 8:
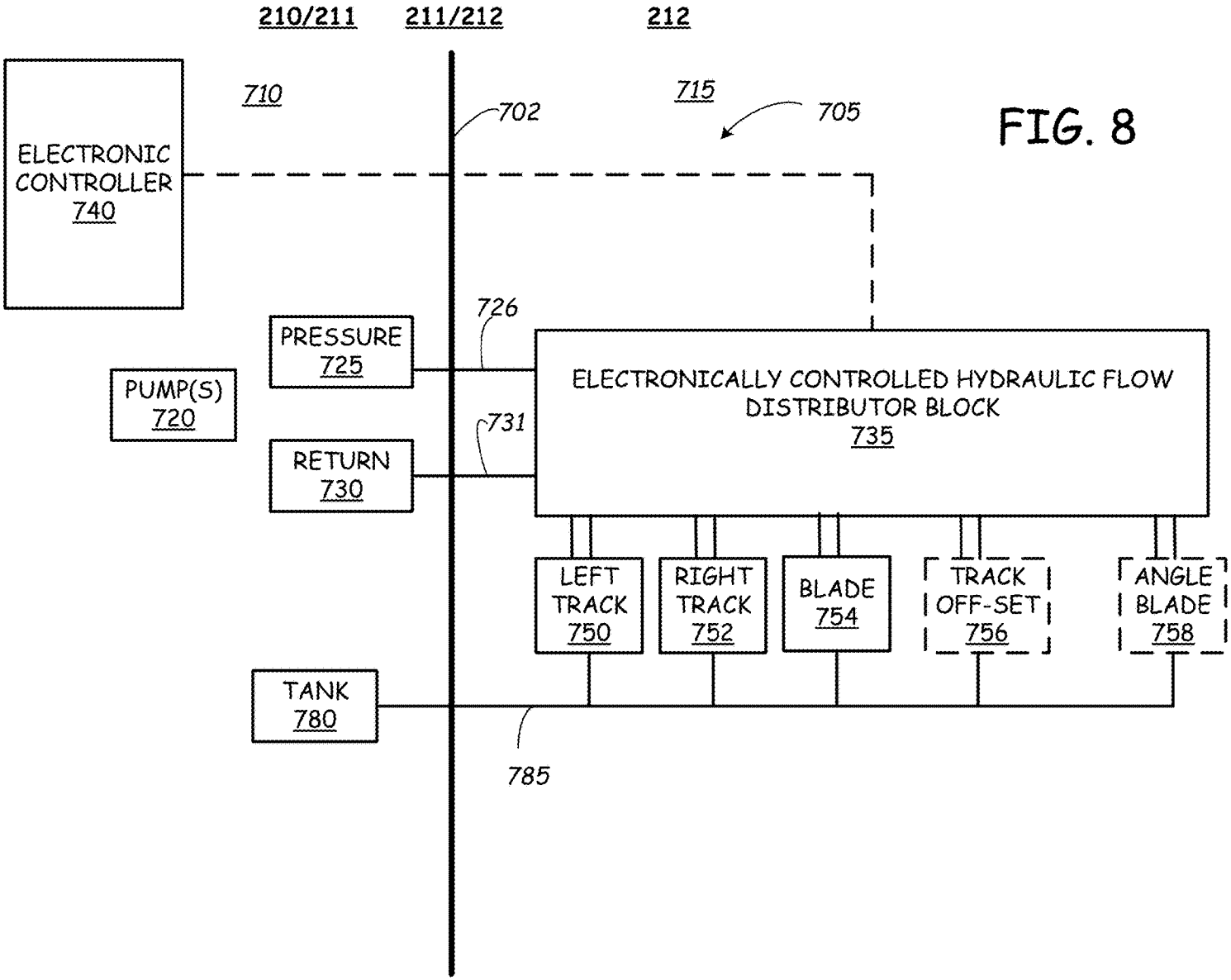
FIG. 8 is a block diagram illustrating a distributed hydraulic system in accordance with another exemplary embodiment, which reduces a number of hydraulic lines routed through a swivel joint.

The disclosed electronically controlled distributor block concepts can also be used to reduce the number of hydraulic lines passing through the swivel joint between upper frame portion or house 211 and lower frame portion or undercarriage 212. As shown in FIG. 8, hydraulic system 705 includes hydraulic system components 710 which are positioned on frame/house 210/211, including components such as one or more hydraulic pumps 720, a hydraulic fluid reservoir or tank 780, and other components which control the flow of pressurized hydraulic fluid on lines through the swivel joint 702. In the exemplary embodiment of FIG. 8, hydraulic system components 710 also include a control valve or other devices for providing pressurized hydraulic fluid at pressure connection 725 coupled to hydraulic hose 726 that extends through swivel 702. It should be noted that while hydraulic lines extend through the swivel joint 702, in some embodiments, there is a manifold that makes connections between hoses on either side of the swivel so that hoses are not rotating am movement occurs at the swivel joint. Similarly, hydraulic system components 710 also include a return hydraulic connection 730 coupled to a return hydraulic hose 731 also extending through swivel 702. Finally, a hydraulic hose 785 connected to tank 780 is a third hydraulic line extending through swivel 702.

Hydraulic components 715 on the undercarriage side of the swivel joint 702 include an electronically controlled hydraulic flow distributor block 735 that is coupled to the pressure and return hydraulic hoses 726 and 731 and is controlled by electronic controller 740 to distribute pressurized hydraulic fluid to actuators of hydraulic components 715 to perform functions as described below. Similar to the distributor blocks described above, distributor block 735 contains multiple valve bodies that are configured to control these multiple functions or actuators on the undercarriage.

For example, in an exemplary embodiment, distributor block 735 selectively provides pressurized hydraulic fluid to left track motor 750 and right track motor 752 to control travel of the power machine. Also, distributor block 735 selectively provides pressurized hydraulic fluid to a lower implement or blade actuator 754 to raise and lower the implement (e.g., implement 334 shown in FIGS. 2 and 3). Further, in some optional embodiments, distributor block 735 selectively provides pressurized hydraulic fluid to other actuators such as a track offset actuator 756 or an angle blade actuator 758.

Figure 9:
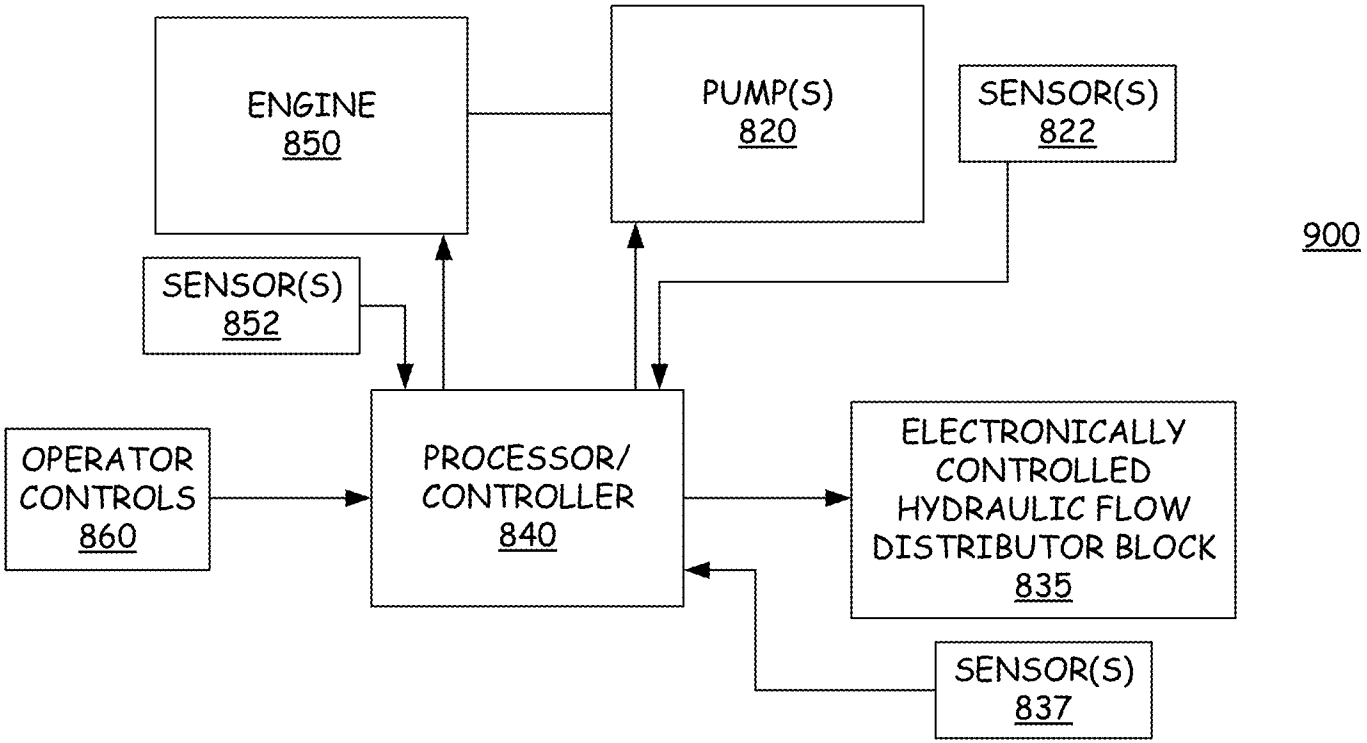
FIG. 9 is a block diagram of a system utilizing distributed hydraulic concepts and feedback sensors to provide improved control of engine, pump and/or hydraulic components.

Referring now to FIG. 9, shown is a system 900 which utilizes the above-described hydraulic flow distributer block concepts to provide controlled feedback in a "fly-by-wire" type of system that monitors pressures and flows throughout the system and, providing feedback of the pressures and/or flows to a control computer 840, allows regulation and control of the power source (e.g., engine 850 and/or pump(s) 820) and the control actuators (e.g., via distributor block 835) to deliver improved or optimized performance. As shown, system 900 includes power source components such as hydraulic pump(s) 820 and an engine 850. Feedback sensor(s) 822 provide feedback signals or feedback data to a controller 840 regarding the pressures and/or flows in pumps 820. Sensor(s) 852 provide feedback signals or feedback data to controller 840 regarding engine parameters, such as temperature, pressures, engine speed (RPMs), etc. Sensor(s) 837 provide feedback signals or feedback data to controller 840 regarding the pressures and/or flows in the distributor block 835 or in outputs/inputs of the distributor block. Responsive to operator control signals from operator controls 860 (e.g., joystick controllers, switches, foot pedals, or other operator input devices), controller 840 can generate control signals to control engine 850, pump(s) 820, and hydraulic flow distributor block 835 to control work functions as described above with reference to disclosed exemplary embodiments. Then, using the feedback from sensors 852, 822 and 837, controller 840 can monitor pressures and operating conditions to control engine 850, pump(s) 820 and/or distributor block 835 to optimize performance of the system.

Although the present invention has been described with reference to preferred embodiments, workers skilled in the art will recognize that changes may be made in form and detail without departing from the scope of the discussion.

What is claimed is:

1. A power machine comprising:

a frame having a first frame portion;

a lift arm structure pivotally coupled to the first frame portion such that the lift arm structure can be raised and lowered;

first hydraulic system components positioned on the first frame portion, the first hydraulic system components including at least one hydraulic pump configured to selectively provide pressurized hydraulic fluid;

a supply hose configured to carry pressurized hydraulic fluid from the at least one hydraulic pump;

a return hose configured to carry a return flow of hydraulic fluid;

second hydraulic system components, the second hydraulic system components including a first electronically controlled hydraulic flow distributor block positioned on the lift arm structure, the first electronically controlled hydraulic flow distributor block configured to receive the pressurized hydraulic fluid from the supply hose and to selectively divert the pressurized hydraulic fluid to different ones of multiple actuators on the lift arm structure; and an electronic controller positioned on the frame and configured to control the first electronically controlled hydraulic flow distributor block to control the different ones of the multiple actuators on the lift arm structure;

wherein the first electronically controlled hydraulic flow distributor block is positioned at least partially within an arm of the lift arm structure.

2. The power machine of claim 1, wherein the first electronically controlled hydraulic flow distributor block is at least partially positioned within a boom of the lift arm structure.

3. The power machine of claim 1, wherein the first electronically controlled hydraulic flow distributor block includes a plurality of valve bodies each configured to control diversion of the pressurized hydraulic fluid to a different one of the multiple actuators on the lift arm structure.

4. The power machine of claim 3, and further comprising a plurality of quick couplers configured to removably couple the multiple actuators on the lift arm structure to the first electronically controlled hydraulic flow distributor block.

5. The power machine of claim 1, wherein the multiple actuators on the lift arm structure include a lift actuator configured to raise and lower a boom of the lift arm structure, a dipper actuator configured to move a dipper arm relative to the boom, and an implement carrier actuator configured to move an implement carrier relative to the dipper arm.

6. A power machine comprising:

a frame having a first frame portion;

a lift arm structure pivotally coupled to the first frame portion such that the lift arm structure can be raised and lowered;

first hydraulic system components positioned on the first frame portion, the first hydraulic system components including at least one hydraulic pump configured to selectively provide pressurized hydraulic fluid;

a supply hose configured to carry pressurized hydraulic fluid from the at least one hydraulic pump;

a return hose configured to carry a return flow of hydraulic fluid;

second hydraulic system components, the second hydraulic system components including a first electronically controlled hydraulic flow distributor block positioned on the lift arm structure, the first electronically controlled hydraulic flow distributor block configured to receive the pressurized hydraulic fluid from the supply hose and to selectively divert the pressurized hydraulic fluid to different ones of multiple actuators on the lift arm structure; and an electronic controller positioned on the frame and configured to control the first electronically controlled hydraulic flow distributor block to control the different ones of the multiple actuators on the lift arm structure;

wherein the frame includes an undercarriage, and wherein the first frame portion comprises a house pivotally mounted on the undercarriage by a swivel joint.

7. The power machine of claim 6, and further comprising a swing mount pivotally coupling the lift arm structure to the house, the swing mount configured to allow the lift arm structure to pivot laterally relative to the house under the control of a swing actuator, and wherein the supply hose and the return hose are routed through the swing mount.

8. The power machine of claim 6, wherein the first electronically controlled hydraulic flow distributor block is positioned at least partially within an arm of the lift arm structure.

9. A power machine comprising:

a frame having a first frame portion;

a lift arm structure pivotally coupled to the first frame portion such that the lift arm structure can be raised and lowered;

first hydraulic system components positioned on the first frame portion, the first hydraulic system components including at least one hydraulic pump configured to selectively provide pressurized hydraulic fluid;

a supply hose configured to carry pressurized hydraulic fluid from the at least one hydraulic pump;

a return hose configured to carry a return flow of hydraulic fluid;

second hydraulic system components, the second hydraulic system components including a first electronically controlled hydraulic flow distributor block positioned on the lift arm structure, the first electronically controlled hydraulic flow distributor block configured to receive the pressurized hydraulic fluid from the supply hose and to selectively divert the pressurized hydraulic fluid to different ones of multiple actuators on the lift arm structure; and an electronic controller positioned on the frame and configured to control the first electronically controlled hydraulic flow distributor block to control the different ones of the multiple actuators on the lift arm structure;

wherein the second hydraulic system components further include a second electronically controlled hydraulic flow distributor block positioned on the lift arm structure and coupled in-line to the first electronically controlled hydraulic flow distributor block by a first hose and a second hose, the second electronically controlled hydraulic flow distributor block configured to receive the pressurized hydraulic fluid from the supply hose and to provide the pressurized hydraulic fluid through the first hose to the first electronically controlled hydraulic flow distributor block.

10. The power machine of claim 9, wherein the electronic controller is further configured to control the second electronically controlled hydraulic flow distributor block.

11. A power machine comprising:

a frame having a first frame portion;

a lift arm structure pivotally coupled to the first frame portion such that the lift arm structure can be raised and lowered;

first hydraulic system components positioned on the first frame portion, the first hydraulic system components including at least one hydraulic pump configured to selectively provide pressurized hydraulic fluid;

a supply hose configured to carry pressurized hydraulic fluid from the at least one hydraulic pump;

a return hose configured to carry a return flow of hydraulic fluid;

second hydraulic system components, the second hydraulic system components including a first electronically controlled hydraulic flow distributor block positioned on the lift arm structure, the first electronically controlled hydraulic flow distributor block configured to receive the pressurized hydraulic fluid from the supply hose and to selectively divert the pressurized hydraulic fluid to different ones of multiple actuators on the lift arm structure; and an electronic controller positioned on the frame and configured to control the first electronically controlled hydraulic flow distributor block to control the different ones of the multiple actuators on the lift arm structure;

an engine configured to drive the at least one hydraulic pump;

at least one engine feedback sensor configured to provide the electronic controller engine operational feedback signals or data;

at least one pump feedback sensor configured to provide the electronic controller pump feedback signals or data indicative of pressure or flow of hydraulic fluid in the at least one hydraulic pump;

at least one distributor block feedback sensor configured to provide the electronic controller distributor block pressure feedback signals or data indicative of pressure or flow of hydraulic fluid in the first electronically controlled hydraulic flow distributor block;

wherein the electronic controller is configured to control the engine, the at least one hydraulic pump and the first electronically controlled hydraulic flow distributor block responsive to the engine operational feedback signals or data, the pump feedback signals or data and the distributor block pressure feedback signals or data.

12. A power machine comprising:

a frame having a house and an undercarriage;

a swivel joint pivotally coupling the house to the undercarriage;

a lift arm structure pivotally coupled to the house such that the lift arm structure can be raised and lowered;

first hydraulic system components positioned on the house, the first hydraulic system components including at least one hydraulic pump configured to selectively provide pressurized hydraulic fluid;

a supply hose routed through the swivel joint and configured to carry pressurized hydraulic fluid from the at least one hydraulic pump;

a return hose routed through the swivel joint and configured to carry a return flow of hydraulic fluid;

second hydraulic system components, the second hydraulic system components including a first electronically controlled hydraulic flow distributor block positioned on the undercarriage, the first electronically controlled hydraulic flow distributor block configured to receive the pressurized hydraulic fluid from the supply hose and to selectively divert the pressurized hydraulic fluid to different ones of multiple actuators supported by the undercarriage; and an electronic controller positioned on the frame and configured to control the first electronically controlled hydraulic flow distributor block to control the different ones of the multiple actuators supported by the undercarriage.

13. The power machine of claim 12, and further comprising a swing mount pivotally coupling the lift arm structure to the house, the swing mount configured to allow the lift arm structure to pivot laterally relative to the house under the control of a swing actuator.

14. The power machine of claim 12, wherein the first electronically controlled hydraulic flow distributor block includes a plurality of valve bodies each configured to control diversion of the pressurized hydraulic fluid to a different one of the multiple actuators supported by the undercarriage.

15. The power machine of claim 14, wherein the multiple actuators supported by the undercarriage include first and second travel motors configured to control travel of the power machine.

16. The power machine of claim 15, and further comprising first and second track assemblies coupled to and disposed on opposing sides of the undercarriage, the first and second track assemblies each driven by a respective one of the first and second travel motors.

17. The power machine of claim 16, wherein the multiple actuators supported by the undercarriage include at least one of a track offset actuator and an angle blade actuator.

18. The power machine of claim 14, wherein the multiple actuators supported by the undercarriage include a lower implement actuator configured raise and lower a lower implement mounted on the undercarriage.

19. The power machine of claim 12, and further comprising:

an engine configured to drive the at least one hydraulic pump;

at least one engine feedback sensor configured to provide the electronic controller engine operational feedback signals or data;

at least one pump feedback sensor configured to provide the electronic controller pump feedback signals or data indicative of pressure or flow of hydraulic fluid in the at least one hydraulic pump;

at least one distributor block feedback sensor configured to provide the electronic controller distributor block pressure feedback signals or data indicative of pressure or flow of hydraulic fluid in the first electronically controlled hydraulic flow distributor block;

wherein the electronic controller is configured to control the engine, the at least one hydraulic pump and the first electronically controlled hydraulic flow distributor block responsive to the engine operational feedback signals or data, the pump feedback signals or data and the distributor block pressure feedback signals or data.

* * * * *